United States Patent [19]

Peterson et al.

[11] Patent Number: 4,556,468

[45] Date of Patent: Dec. 3, 1985

[54] ELECTROLYTIC CELL

[75] Inventors: Richard W. Peterson; Richard L. Rolf, both of New Kensington, Pa.

[73] Assignee: Aluminum Company of America, Pittsburgh, Pa.

[21] Appl. No.: 654,420

[22] Filed: Sep. 26, 1984

[51] Int. Cl.[4] ..... C25C 3/00; C25C 7/00

[52] U.S. Cl. ..... 204/243 R; 204/294

[58] Field of Search ..... 204/243 R, 244–247, 204/294

[56] References Cited

U.S. PATENT DOCUMENTS

| | | | |
|---|---|---|---|
| 2,861,036 | 11/1958 | Simon-Suisse | 204/243 R |
| 3,421,995 | 1/1969 | Morel et al. | 204/243 R |
| 3,494,851 | 2/1970 | Cauvin, Jr. | 204/243 R |
| 3,702,815 | 11/1972 | Nikiforov et al. | 204/243 R X |
| 4,124,476 | 11/1978 | Rapolthy | 204/243 R |
| 4,322,282 | 3/1982 | Jemec | 204/243 R |
| 4,421,625 | 12/1983 | Fischer et al. | 204/243 R |
| 4,488,955 | 12/1984 | Bertaud et al. | 204/243 R |

*Primary Examiner*—Donald R. Valentine

*Attorney, Agent, or Firm*—Daniel A. Sulivan, Jr.

[57] ABSTRACT

In an electrolytic cell having a floor and a boundary for the floor, the cell having a short side and a long side, the improvement including greater compressibility in the boundary on the short side of the cell, as compared to the long side of the cell, in an amount effective for accommodating longitudinally directed expansion of the floor, to counteract longitudinal cracking of the floor.

4 Claims, 4 Drawing Figures

ELECTROLYTIC CELL

BACKGROUND OF THE INVENTION

Russian Author's Certificate No. 755,896 proposes the use of articulated joints in the floors of Hall-Heroult cells for producing aluminum. The purpose of such joints is to prevent formation of longitudinal cracks.

U.S. Pat. No. 4,124,476 shows the use of compressible material in a cell wall. Two grades of compressible material are used, with the upper, less compressible material giving rise to a reaction force to counteract bulging and cracking of the cell floor.

SUMMARY OF THE INVENTION

It is an object of the invention to provide a novel electrolytic cell construction for resisting longitudinal cracking of cell floors.

This as well as other objects which will become apparent in the discussion that follows are achieved, according to the present invention, by providing, in an electrolytic cell having a floor and a boundary for the floor, the cell having a short side and a long side, the improvement including greater compressibility in the boundary on the short side of the cell, as compared to the long side of the cell, in an amount effective for accommodating longitudinally directed expansion of the floor, to counteract longitudinal cracking of the floor.

DESCRIPTION OF THE PREFERRED EMBODIMENTS

Typically, Hall-Heroult cells for producing Al are built to have a long and narrow, generally rectangular shape, as seen from above. This leads to an aspect ratio, long dimension to short dimension, greater than 1.

For example, the length and width of one industrial cell are 300 inches and 100 inches, respectively.

As these cells age during use, a common mode of failure is the longitudinal cracking referred to in the above-cited Russian No. 755,896. These longitudinal cracks run in the long direction of the cell, typically along the middle of the floor. Molten Al penetrates into them, this contributing to cell failure.

Figure 4:
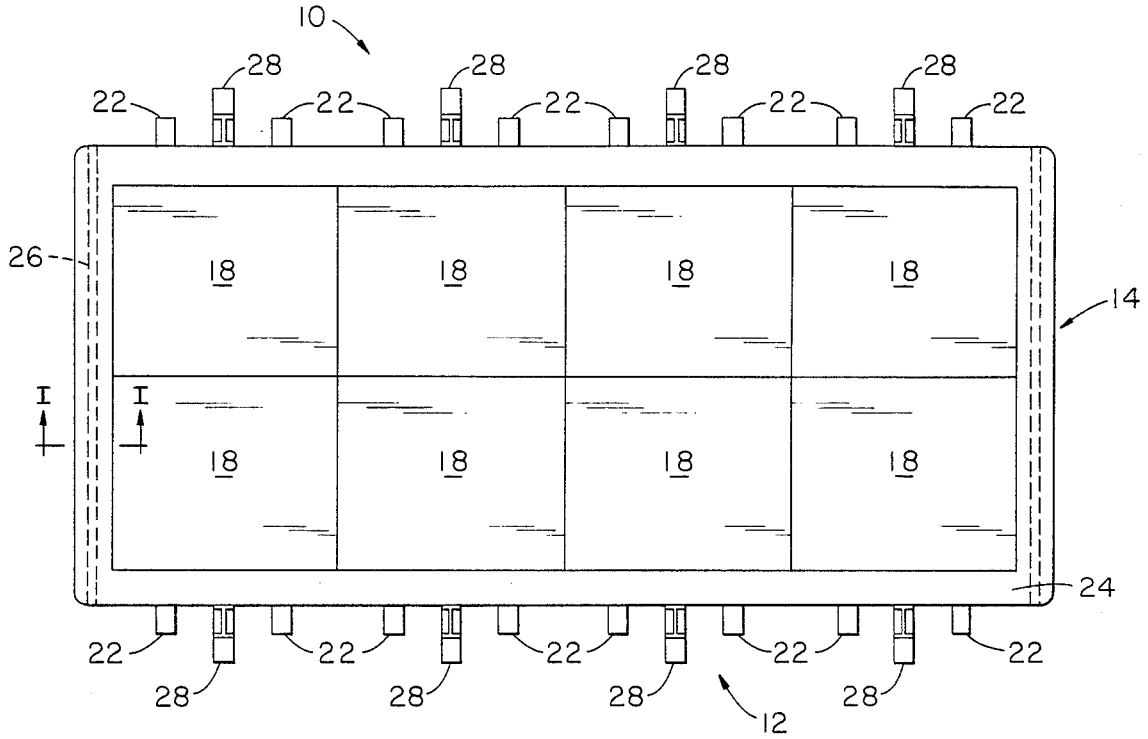
FIG. 4 is a plan view of a Hall-Heroult cell for producing Al.

Referring first to FIG. 4, the drawing shows a bird's-eye view of a Hall-Heroult cell 10. The usual anodes and supporting superstructure have been removed to show just the pot portion of the cell. The cell has a long side 12 and a short side 14.

Figure 1:
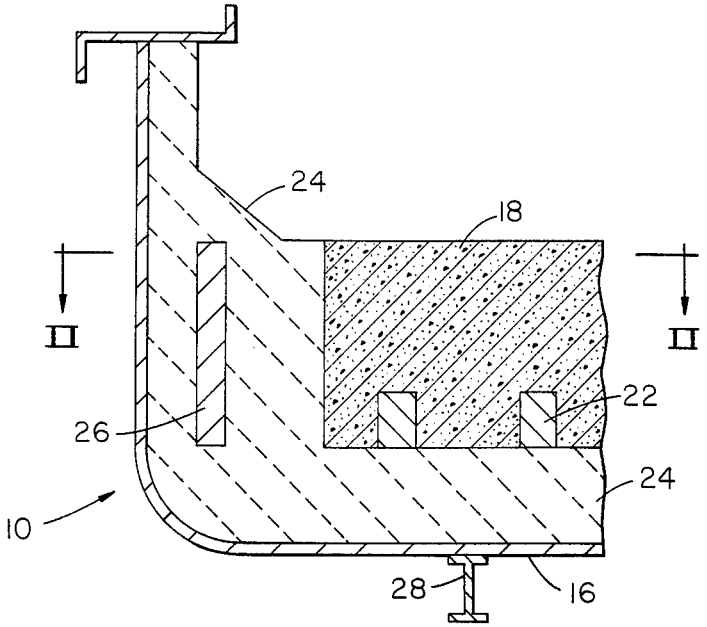
FIG. 1 is an elevational cross section taken along the cutting plane I—I of FIG. 4.
Figure 3:
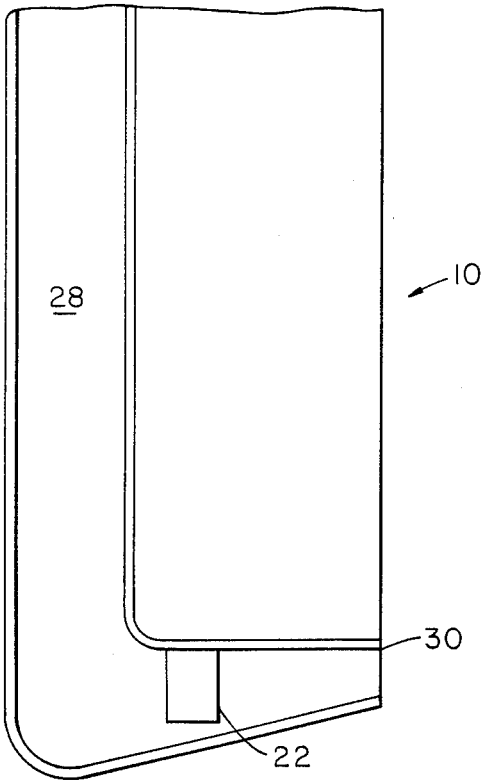
FIG. 3 is a view as seen in the direction indicated by III—III in FIG. 2.
Figure 2:
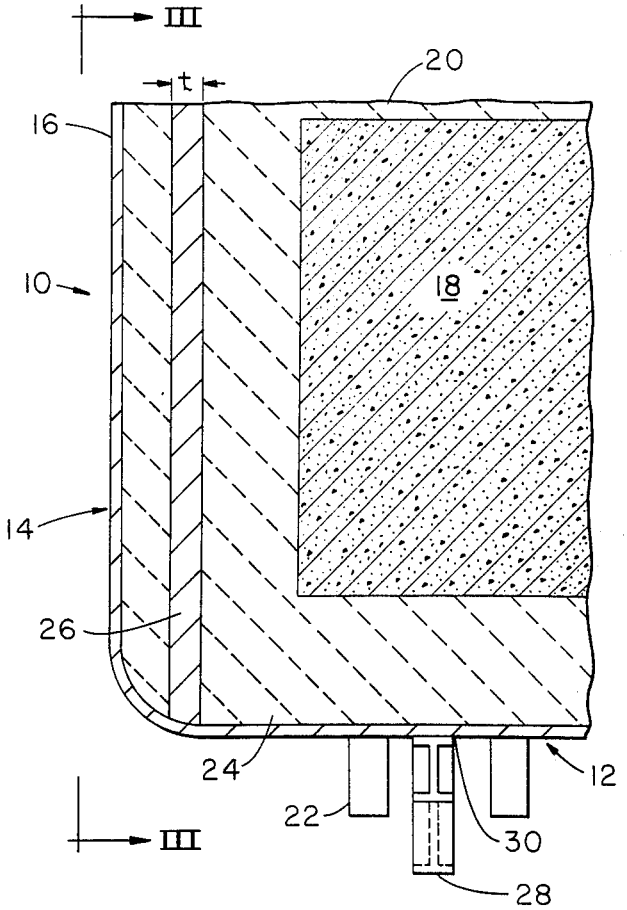
FIG. 2 is a plan cross-sectional view taken along the cutting plane II—II of FIG. 1.

FIGS. 1 to 3 show the cell in greater detail. The cell includes a metal, steel, shell 16 and carbon blocks 18. The blocks comprise the floor of the cell. Typically, seams 20 are left between the blocks, the seams being filled with a carbonaceous seam mix such as that disclosed in U.S. Pat. No. 4,032,653.

The blocks 18 contain metal bars 22 for collecting the electrical current used for electrolysis.

The floor has a boundary 24 which extends to contact surrounding shell 16. It is well known to construct the boundary of various materials, including carbonaceous seam mix, refractory brick, anthracite brick, graphite brick, powdered alumina, etc.

A characteristic of the present invention is the provision of a compressible material 26 in the boundary on the short side of the cell such that there is a greater compressibility in the boundary on the short side of the cell as compared to the long side of the cell.

The use of compressible material in the present invention is a quite different concept as compared to the use in the above-referenced U.S. Pat. No. 4,124,476, where application of its reaction force on the short side of the cell would worsen longitudinal cracking. The effect would be like pushing inwardly on the ends of an unzipped pipe tobacco pouch, the result being to buckle any incipient longitudinal crack open.

The boundary on the long side of the cell can be constructed as in U.S. Pat. No. 4,124,476, or it can be made of all rigid material. The cell is shown set in steel cradles 28, and, to the extent that any air gaps exist at locations 30 along the cell long side between the shell and the cradles, these gaps can be filled completely or partially by metal shims (not shown), in order to increase rigidity on the long side of the cell.

Compressible material 26 has preferably a vertical dimension matching, or greater than, that of the carbon floor blocks 18.

The amount of compressibility can be determined without undue experimentation. In general, it must be enough to accommodate thermal expansion of the floor plus floor expansion due to sodium intercalation into the carbon blocks minus the thermal expansion of the steel shell.

Suitable examples of compressible material 26 are metal honeycomb, such as that used in airplane wings, or foamed ceramics. Suitable peak crush strength is 100 psi, or less, when testing at the operating temperature or when testing at room temperature, after having been heated to the operating temperature.

A suitable thickness (t (FIG. 2), in the longitudinal direction of the cell) for material 26 is at least 1 inch to not more than 0.00825 L, where L is the length of the pot in inches.

This is determined as follows:

Consider temperature of steel—200° C. to 400° C.

Consider temperature of cathode block—900° C. to 960° C.

Consider Na intercalation—0.1% to 0.5%

---

Expansion of Steel:

$\Delta L_{ST} = \alpha_{ST} L \Delta T_{ST}$

Expansion of Cathode Block:

$\Delta L_{CB} = \alpha_{CB} L \Delta T_{CB} + \Delta L_{Na}$ $\Delta L_{Na}$ = % Na exp. × L/100

Difference = $\Delta L_{CB} - \Delta L_{ST}$

Thickness of crushable insulation = 1 to 2 × (Difference/2) at each end:

$t = \alpha_{CB} L \Delta T_{CB} + \Delta L_{Na} - \alpha_{ST} L \Delta T_{ST}$ if 2x lower bound:

CB temperature = 900° C. (1652° F.)

$\Delta L_{Na}$ = 0.001 L

ST temperature = 400° C. (752° F.)

upper bound:

CB temperature = 960° C. (1760° F.)

$\Delta L_{Na}$ = 0.005 L

ST temperature = 200° C. (392° F.)

Steel:

-continued $\alpha_{400} = 0.00000682/°F. \times 9/5 = 0.00001228/° C.$ $\alpha_{750} = 0.00000754/°F. \times 9/5 = 0.00001357/°C.$ Cathode Block:

$\alpha = 0.00000323/°F. \times 9/5 = 0.00000581/°C.$ lower bound:

$t = 0.00000581\ L\ (880) + 0.001\ L - 0.00001357\ L\ (380)$
$= 0.0009562\ L$ make at least 1 inch for handling consideration upper bound:

$t = 0.00000581\ L\ (940) + 0.005\ L - 0.00001228\ L\ (180)$
$= 0.008251\ L$

What is claimed is:

1. In an electrolytic cell having a floor, a boundary for the floor, and a metal shell surrounding the boundary, the cell having a short side and a long side, the improvement comprising a material of greater compressibility in the boundary on the short side of the cell, as compared to the long side of the cell, in an amount effective for accommodating longitudinally directed expansion of the floor, to counteract longitudinal cracking of the floor.

2. A cell as claimed in claim 1, the floor comprising carbon blocks, the compressibility being provided by a material whose vertical dimension is at least as great as the vertical dimension of the block.

3. A cell as claimed in claim 1, the shell contacting the boundary, with the cell sitting in cradles contacting the long side of the cell either directly or by way of shims.

4. In an electrolytic cell having a floor and a boundary for the floor, the cell having a short side and a long side, the improvement comprising greater compressibility in the boundary on the short side of the cell, as compared to the long side of the cell, in an amount effective for accommodating longitudinally directed expansion of the floor, to counteract longitudinal cracking of the floor, the floor comprising carbon blocks, the compressibility being provided by a material whose vertical dimension is at least as great as the vertical dimension of the block, the material having a thickness in the range one inch to 0.00825 L, where L is the length of the long side in inches.

* * * * *